US010590928B2

(12) United States Patent
McGowan et al.

(10) Patent No.: US 10,590,928 B2
(45) Date of Patent: Mar. 17, 2020

(54) GEAR PUMP THAT REMOVES AIR FROM PUMPED OIL

(71) Applicant: GM Global Technology Operations LLC, Detroit, MI (US)

(72) Inventors: Sean M. McGowan, Northville, MI (US); Mark R. Claywell, Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 263 days.

(21) Appl. No.: 15/824,542

(22) Filed: Nov. 28, 2017

(65) Prior Publication Data

US 2019/0162182 A1 May 30, 2019

(51) Int. Cl.

| | |
|---|---|
| ***F01C 1/18*** | (2006.01) |
| ***F03C 2/00*** | (2006.01) |
| ***F03C 4/00*** | (2006.01) |
| ***F04C 2/00*** | (2006.01) |
| ***F04C 2/10*** | (2006.01) |
| ***F04C 2/08*** | (2006.01) |
| ***F04C 2/18*** | (2006.01) |
| *F04C 15/06* | (2006.01) |

(52) U.S. Cl.

CPC ..... *F04C 2/102* (2013.01); *F04C 2/084* (2013.01); *F04C 2/18* (2013.01); *F04C 15/06* (2013.01); *F04C 2210/206* (2013.01); *F04C 2220/20* (2013.01)

(58) Field of Classification Search

CPC ..... F04C 2/18; F04C 2210/206; F04C 2/084; F04C 2/102; F04C 15/06; F04C 2220/20

USPC ..... 418/15, 189–190, 206.1–206.9

See application file for complete search history.

(56) References Cited

U.S. PATENT DOCUMENTS

| | | | | | |
|---|---|---|---|---|---|
| 3,096,719 | A * | 7/1963 | McAlvay | F04C 15/0026 | 418/132 |
| 3,280,756 | A * | 10/1966 | Gordon | F04C 15/0026 | 418/132 |
| 3,433,168 | A * | 3/1969 | Banker | F04C 15/0026 | 418/206.6 |
| 4,090,820 | A * | 5/1978 | Teruyama | F04C 15/0026 | 418/132 |
| 4,231,726 | A * | 11/1980 | Cobb | F04C 2/084 | 418/206.5 |
| 2009/0148333 | A1* | 6/2009 | Elder | F04C 2/086 | 418/206.7 |
| 2018/0172636 | A1* | 6/2018 | Shaffer | G01N 27/74 | 73/114.4 |

* cited by examiner

*Primary Examiner* — Theresa Trieu
(74) *Attorney, Agent, or Firm* — Reising Ethington, P.C.

(57) ABSTRACT

A gear pump can be equipped in an engine oil system. The gear pump has a housing, a first gear, and a second gear. The housing has an outlet passage for exiting oil, and has one or more outlet openings for exiting air. The first gear has a set of first teeth with multiple first roots and first tips. The second gear has a set of second teeth with multiple second roots and second tips. The outlet opening(s) is situated in the housing so that it can communicate with a first clearance, with a second clearance, or with both the first and second clearances. The first clearance is established at the confrontation of one of the first roots and one of the second tips. And the second clearance is established at the confrontation of one of the second roots and one of the first tips.

19 Claims, 4 Drawing Sheets

GEAR PUMP THAT REMOVES AIR FROM PUMPED OIL

INTRODUCTION

The present disclosure relates to gear pumps used to move oil in internal combustion engine assemblies.

Gear pumps are common in internal combustion engine assemblies, such as in automotive applications. In a dry sump engine oil system, for instance, gear pumps move oil from a sump, to a tank, and then to an engine. Amid this movement, air can be introduced into the oil. Too much air in oil has been shown in some cases to diminish the effectiveness of the oil when put to use. Hence, air-oil separators are used to remove air from oil in some dry sump engine oil systems.

SUMMARY

In an embodiment, a gear pump includes a housing, a first gear, and a second gear. The housing has an outlet passage for oil to exit the gear pump. The housing also has one or more outlet openings for air to exit the gear pump. The first gear is disposed within the housing. The first gear has a set of first teeth with multiple first roots and multiple first tips. The second gear is disposed within the housing. The second gear has a set of second teeth with multiple second roots and multiple second tips. The outlet opening(s) is situated at a location in the housing to communicate with a first clearance established between a confronting first root and second tip. Or the outlet opening(s) is situated at a location in the housing to communicate with a second clearance established between a confronting second root and first tip. Or the outlet opening(s) is situated at a location in the housing to communicate with both of the first and second clearances, when the first clearance is established and then when the second clearance is established.

In an embodiment, the outlet opening(s) is situated at a timing rib of the housing. The timing rib is interposed between a vacuum side of the gear pump and a pressure side of the gear pump.

In an embodiment, the outlet opening(s) is situated adjacent a first tip circumference of the first tips. Or the outlet opening(s) is situated adjacent a second tip circumference of the second tips. Or the outlet opening(s) is situated adjacent both of the first and second tip circumferences.

In an embodiment, the outlet opening(s) is situated adjacent a first root circumference of the first roots. Or the outlet opening(s) is situated adjacent a second root circumference of the second roots. Or the outlet opening(s) is situated adjacent both of the first and second root circumferences.

In an embodiment, the first gear, the second gear, and the outlet opening(s) are configured in order to urge air captured within the first clearance, or captured within the second clearance, or captured within both of the first and second clearances, to exit the gear pump by way of the outlet opening(s) when the first and second teeth mesh together.

In an embodiment, the outlet opening(s) includes a first outlet opening and a second outlet opening. The first outlet opening is situated at a first location in the housing that communicates with the first clearance, when the first clearance is established. The second outlet opening is situated at a second location in the housing that communicates with the second clearance, when the second clearance is established.

In an embodiment, the outlet opening(s) is a single outlet opening that is situated in the housing to communicate with both of the first clearance and the second clearance, when the first clearance is established and then when the second clearance is established.

In an embodiment, the gear pump includes a valve that is disposed at or near the outlet opening(s). The valve is configured to regulate the exit of air by way of the outlet opening(s).

In an embodiment, the valve regulates the exit of air via the outlet opening(s) based on: pressure of oil, aeration of oil, or temperature of oil. Or, the valve regulates the exit of air via the outlet opening(s) based on a combination of these factors.

In an embodiment, the gear pump includes a clutch mechanism that is operably associated with the first gear, or with the second gear, or with both of the first and second gears. The clutch mechanism is configured to govern rotational speed of the first gear, the second gear, or both of the first and second gears.

In an embodiment, a dry sump engine oil system includes the gear pump. The gear pump serves as a scavenge pump or a pressure pump in the dry sump engine oil system. And the dry sump engine oil system lacks an air-oil separator.

In an embodiment, a gear pump includes a housing, a first gear, and a second gear. The housing has one or more outlet openings for air to exit the gear pump. The first gear is disposed within the housing. The first gear has a set of first teeth with multiple first roots. The first roots define a first root circumference. The second gear is disposed within the housing. The second gear has a set of second teeth with multiple second roots. The second roots define a second root circumference. The outlet opening(s) is situated near the first root circumference. Or the outlet opening(s) is situated near the second root circumference. Or the outlet opening(s) is situated near both of the first and second root circumferences.

In an embodiment, the outlet opening(s) is situated in the housing at a zone of meshing of the set of first and second teeth.

In an embodiment, the outlet opening(s) includes a first outlet opening and a second outlet opening. The first outlet opening is situated along the first root circumference. The second outlet opening is situated along the second root circumference.

In an embodiment, the outlet opening(s) is a single outlet opening. The single outlet opening has a section situated along the first root circumference, and has another section situated along the second root circumference.

In an embodiment, the set of first teeth have multiple first tips and the set of second teeth have multiple second tips. The outlet opening(s) is situated in the housing to communicate with a first clearance established between a confronting first root and second tip. Or the outlet opening(s) is situated in the housing to communicate with a second clearance established between a confronting second root and first tip. Or the outlet opening(s) is situated in the housing to communicate with both of the first and second clearances upon respective establishment thereof.

In an embodiment, the first gear, the second gear, and the outlet opening(s) are configured in order to urge air captured within the first clearance, or captured within the second clearance, or captured within both of the first and second clearances, to exit the gear pump by way of the outlet opening(s) when the first and second teeth mesh together.

In an embodiment, an engine oil system includes the gear pump.

In an embodiment, a gear pump includes a housing, a first gear, and a second gear. The housing has an outlet passage for oil to exit the gear pump. The housing also has one or more outlet openings for air to exit the gear pump. The first gear is disposed within the housing. The first gear has a set of first teeth with multiple first roots and multiple first tips. The first roots define a first root circumference. The second gear is disposed within the housing. The second gear has a set of second teeth with multiple second roots and multiple second tips. The second roots define a second root circumference. The outlet opening(s) is situated near the first root circumference. Or the outlet opening(s) is situated near the second root circumference. Or the outlet opening(s) is situated near both of the first and second root circumferences. Furthermore, the outlet opening(s) is situated at a location in the housing to communicate with a first clearance established between a confronting first root and second tip. Or the outlet opening(s) is situated at a location in the housing to communicate with a second clearance established between a confronting second root and first tip. Or the outlet opening(s) is situated at a location in the housing to communicate with both of the first and second clearances upon respective establishment thereof.

In an embodiment, the outlet opening(s) is situated adjacent a first tip circumference of the first tips. Or the outlet opening(s) is situated adjacent a second tip circumference of the second tips. Or the outlet opening(s) is situated adjacent both of the first and second tip circumferences.

BRIEF DESCRIPTION OF THE DRAWINGS

One or more aspects of the disclosure will hereinafter be described in conjunction with the appended drawings, wherein like designations denote like elements, and wherein.

DETAILED DESCRIPTION

Figure 1:
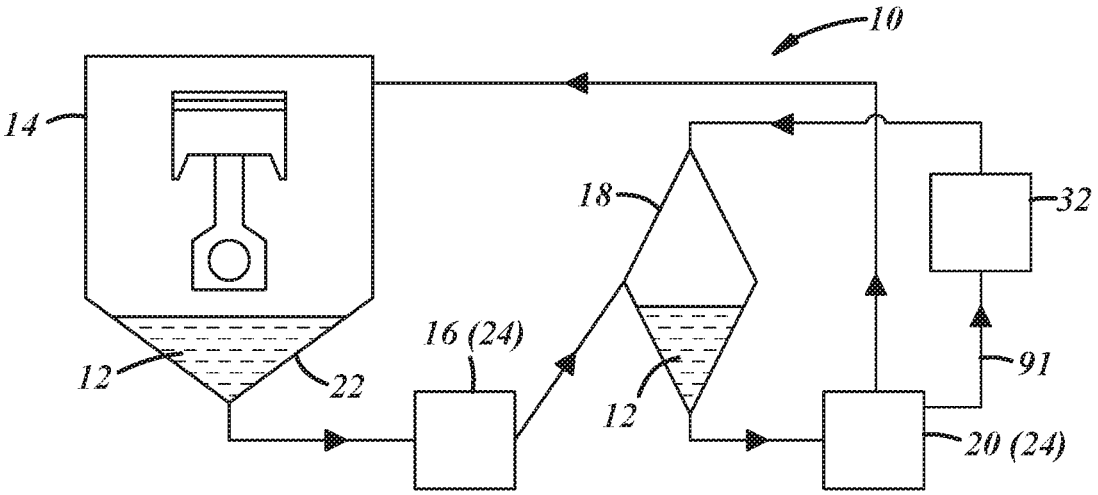
FIG. 1 is a schematic view of an embodiment of a dry sump engine oil system.

Referring to the drawings, a gear pump is designed and constructed to remove air from oil as the oil is moved through the gear pump amid its use. In the embodiments presented, the gear pump carries out this feat without adding to the packaging demands of the gear pump itself, and does away with the need for an air-oil separator and its accompanying packaging demands that would otherwise arise. By removing air, the gear pump helps ensure the effectiveness of the pumped oil. Moreover, effecting removal of air also relieves higher pressures that can build within the gear pump, and hence the overall efficiency of the gear pump is enhanced. The gear pump is described below in the context of an automotive application, yet could be equipped in non-automotive applications as well.

Referring now to FIG. 1, a dry sump engine oil system 10 manages oil circulation within an internal combustion engine assembly in an automobile. Circulated oil 12 may both lubricate and cool parts of an engine 14, such as engine bearings. These types of oil systems are not uncommon in automotive racing applications because they inhibit oil-starvation issues when high g-forces are experienced during swift cornering and during other swift vehicle movements. The oil systems can be equipped in other automotive applications, such as in high performance sports cars. The dry sump engine oil system 10 can have different designs, constructions, and components in different internal combustion engine assemblies. In the embodiment of FIG. 1, the dry sump engine oil system 10 includes the engine 14, a scavenge pump 16, a tank 18, and a pressure pump 20. In general, the oil 12 collects within a sump 22 of the engine 14 and is drawn out of the sump 22 by the scavenge pump 16 and moved to the tank 18. From there, the pressure pump 20 draws the oil 12 out of the tank 18 and propels it to the engine 14 for lubrication and cooling. Additional details of the workings and components of the dry sump engine oil system 10 will be known by those skilled in the art.

Referring generally to FIGS. 2-7, a gear pump 24 is employed to move oil in an engine oil system, and can effect removal and separation of air from the pumped oil. The gear pump 24 can be part of the dry sump engine oil system 10 of FIG. 1—such as by being the scavenge pump 16 and/or the pressure pump 20 (these possibilities are portrayed in FIG. 1 by the numeral twenty-four in parentheses)—or could be installed in another type of engine oil system. Still, more expansively, the gear pump 24 could be installed in any type of hydraulic system in which hydraulic fluid is moved from place to place within the system. The gear pump 24 can have different designs, constructions, and components in different embodiments. In the embodiment of FIGS. 2-7, the gear pump 24 includes a housing 26, a first gear 28, a second gear 30, a valve 32, and a clutch mechanism 34.

Figure 2:
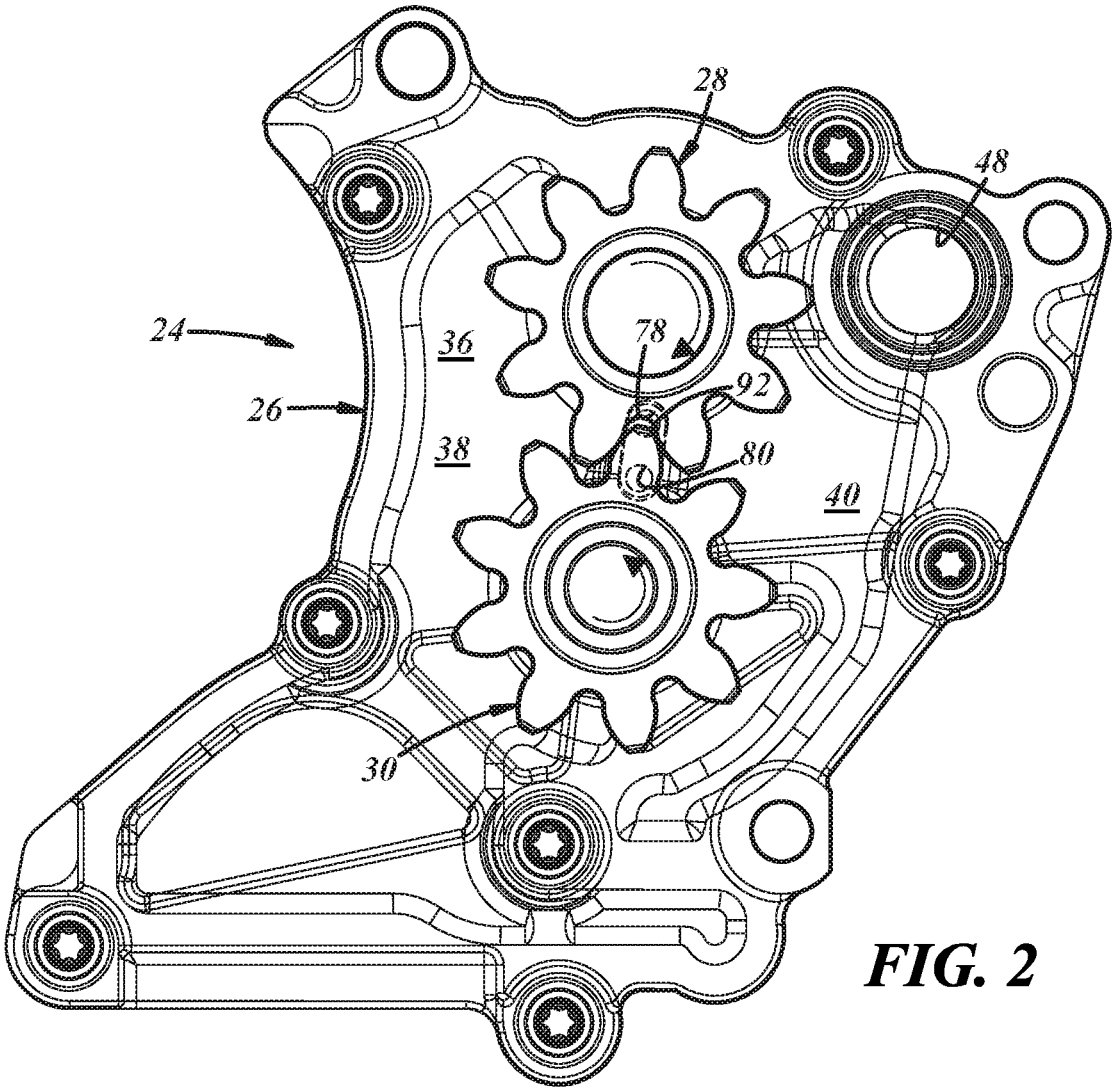
FIG. 2 is a partial inside view of an embodiment of a gear pump.
Figure 6:
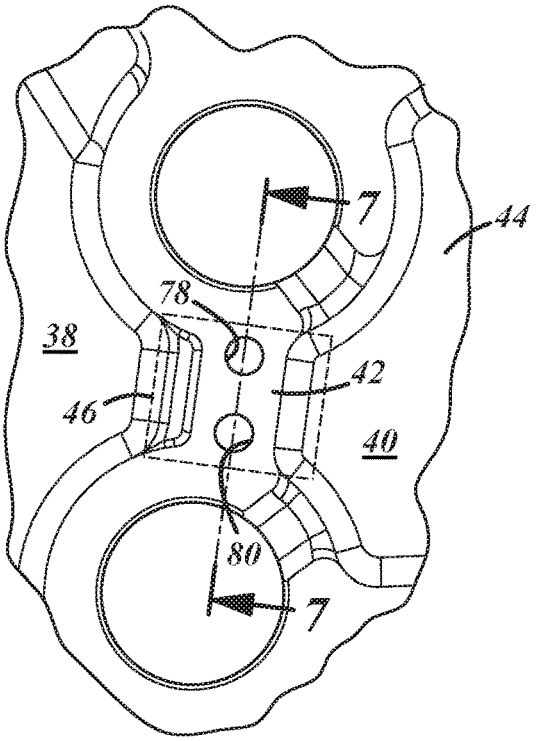
FIG. 6 is an enlarged view of an embodiment of outlet openings of the gear pump of FIG. 2.

The housing 26 supports the first and second gears 28, 30 of the gear pump 24 and contains the oil 12 within its interior 36 as the oil 12 is pumped through the gear pump 24 amid use. FIG. 2 depicts a partial inside view of the housing 26. The housing 26 could include other structures than what is shown in FIG. 2. For example, the housing 26 could include one or more casings, plates, and/or walls—in this regard, the term "housing" is used broadly herein to embrace all of these structures. At the interior 36, the housing 26 has a vacuum side 38 for accepting receipt of the oil 12 as the oil 12 is drawn into the gear pump 24, and has a pressure side 40 where the oil 12 is expelled out of the gear pump 24. The vacuum and pressure sides 38, 40 are sectioned from each other in part by the first and second gears 28, 30. Referring now in particular to FIG. 6, a timing rib 42 protrudes inwardly from an interior surface 44 of the housing 26. Like the first and second gears 28, 30, the timing rib 42 serves as a partial barrier between the vacuum and pressure sides 38, 40, and is interposed between the vacuum and pressure sides 38, 40 at a zone of meshing 46 among teeth of the first and second gears 28, 30. Referring back to FIG. 2, the oil 12 exits the housing 26 by way of an outlet passage 48. The outlet passage 48 is located at the pressure side 40 and serves as the primary exit for the oil 12 out of the gear pump 24 and to downstream components of the larger engine oil system.

Figure 3:
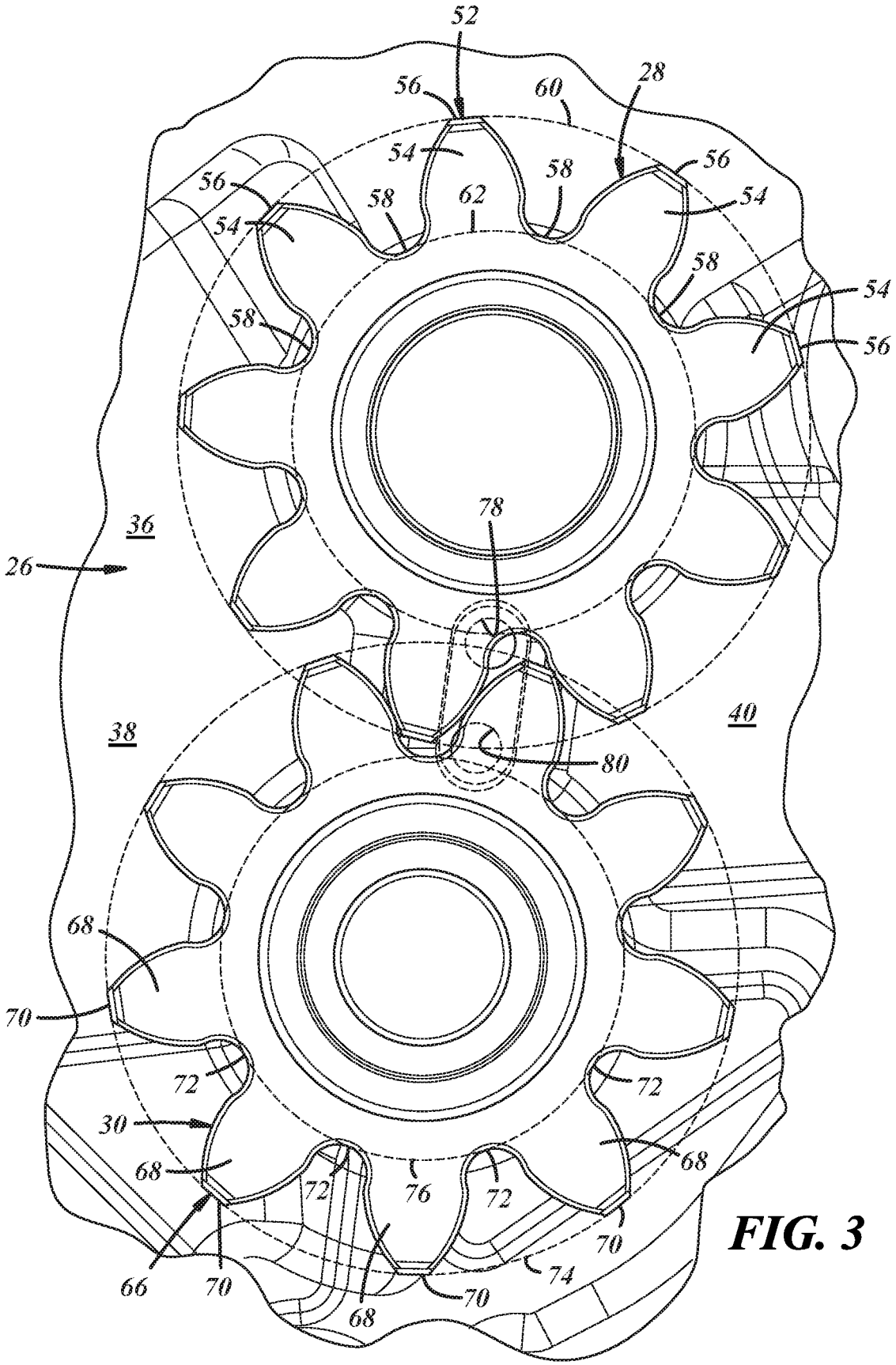
FIG. 3 is an enlarged view of gears of the gear pump of FIG. 2.
Figure 5:
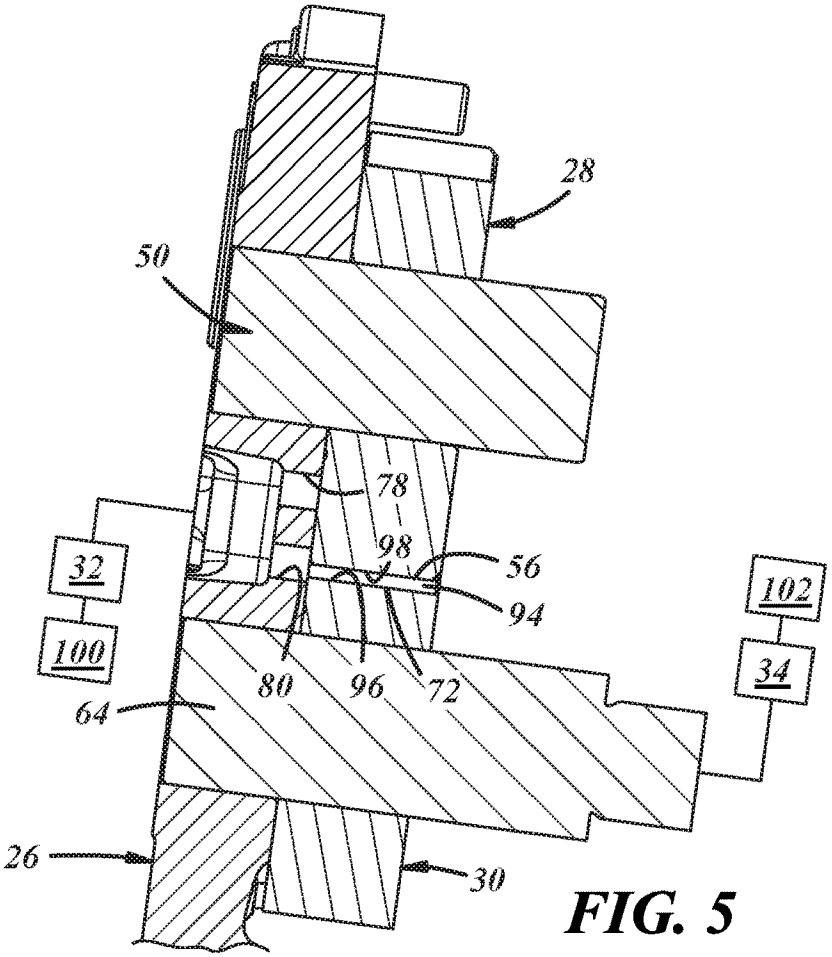
FIG. 5 is a sectional view of the gear pump taken at the arrowed line 5-5 in FIG. 4.
Figure 4:
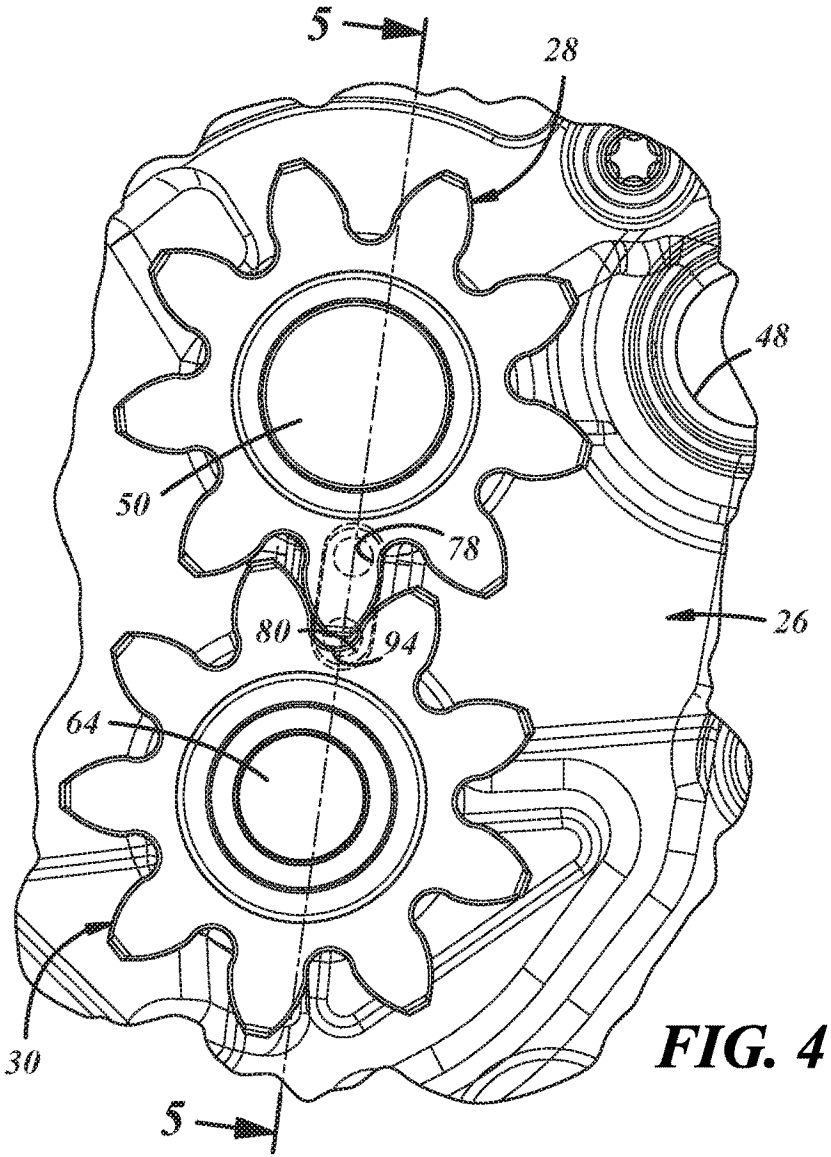
FIG. 4 is another view of the gears of FIG. 3.

The first gear 28 is held in the housing 26 and works with the second gear 30 to paddle and carry the oil 12 from the vacuum side 38 to the pressure side 40 of the housing 26. In this embodiment, the first gear 28 is a spur gear, but could be another type of gear in another embodiment. Referring to FIGS. 4 and 5, the first gear 28 rotates about a first gear shaft 50 in a clockwise rotational direction. Of the pair of gears of the gear pump 24, the first gear 28 is the driven gear. With reference to FIG. 3, the first gear 28 has a set of first teeth 52. The set of first teeth 52 includes multiple individual teeth 54 projecting radially-outwardly relative to the generally circular shape of the first gear 28. Each tooth 54 has a first tip 56, and at a transition between neighboring teeth 54 is a first root 58. Together, the first tips 56 define a first tip circumference 60 and the first roots 58 define a first root circumference 62. As demonstrated in FIG. 3, the first tip circumference 60 is a circumference taken generally at a location of the first tips 56 and is with respect to the generally circular shape of the first gear 28. Likewise, the first root circumference 62 is a circumference taken generally at a location of the first roots 58 and is with respect to the generally circular shape of the first gear 28.

The second gear 30 is held in the housing 26 and works with the first gear 28 to paddle and carry the oil 12 from the vacuum side 38 to the pressure side 40 of the housing 26. In this embodiment, the second gear 30 is a spur gear, but could be another type of gear in another embodiment. Referring to FIGS. 4 and 5, the second gear 30 rotates about a second gear shaft 64 in a counterclockwise rotational direction. The second gear 30 drives rotation of the first gear 28, and itself can be driven off of an engine crankshaft of the larger internal combustion engine assembly. With reference to FIG. 3, the second gear 30 has a set of second teeth 66. The set of second teeth 66 includes multiple individual teeth 68 projecting radially-outwardly relative to the generally circular shape of the second gear 30. Each tooth 68 has a second tip 70, and at a transition between neighboring teeth 68 is a second root 72. Together, the second tips 70 define a second tip circumference 74 and the second roots 72 define a second root circumference 76. As demonstrated in FIG. 3, the second tip circumference 74 is a circumference taken generally at a location of the second tips 70 and is with respect to the generally circular shape of the second gear 30. Likewise, the second root circumference 76 is a circumference taken generally at a location of the second roots 72 and is with respect to the generally circular shape of the second gear 30.

As the oil 12 travels through an engine oil system, such as the dry sump engine oil system 10, air can be introduced into the oil 12. In general, oil imbued with large amounts of air has been shown in some cases to diminish the effectiveness of the oil in use in an internal combustion engine assembly—for instance, air bubbles within oil can hinder the adherence of oil film on surfaces of an engine, such as on engine bearing surfaces. Air-oil separators have been equipped in engine oil systems to separate the air from the oil. While the air-oil separators have been suitable in some engine oil systems, air-oil separators are not always entirely free of drawbacks. Air-oil separators can be distinct components added to an engine oil system, and consequently can add packaging demands on the engine oil system which, in automotive applications, can be exacting. And added air-oil separators can heighten power consumption in the engine oil system.

Figure 7:
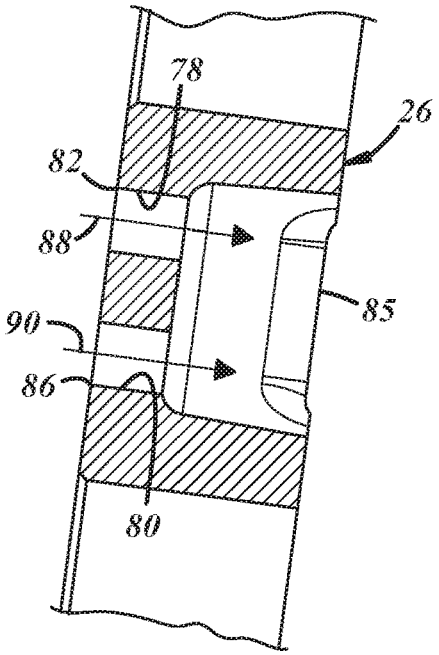
FIG. 7 is a sectional view of the outlet openings taken at the arrowed line 7-7 in FIG. 6.

To resolve some or all of these drawbacks, the gear pump 24 is designed and constructed to remove air from the oil 12 during the gear pump's normal operating mode. Referring again to FIGS. 2-7, in this embodiment the housing 26 has a first outlet opening 78 and a second outlet opening 80 defined and located therein. Since the housing 26 could be the casing(s), plate(s), and/or wall(s), the first and second outlet openings 78, 80 can be defined and located in those structures. Depending on the construction of the housing 26, the first and second outlet openings 78, 80 could be furnished by drilling, could be casted in place, or could be formed another way. Air, as well as some oil in most cases, exits the housing 26 by way of the first and second outlet openings 78, 80. Referring in particular to FIGS. 6 and 7, the first outlet opening 78 extends through the housing 26 from a first inlet 82 to an outlet 85. Similarly, the second outlet opening 80 extends through the housing 26 from a second inlet 86 to the outlet 85. In the embodiment presented, the first and second outlet openings 78, 80 merge together along their respective extents in the housing 26 and share the outlet 85. In other embodiments, the first and second outlet openings 78, 80 need not merge and could have discrete outlets. Air and/or air-oil mixture (hereafter referred to as "air") can travel through the first and second outlet openings 78, 80 via general paths 88, 90. One or more conduits can fluidly communicate with the first and second outlet openings 78, 80 to lead the exiting air downstream and away from the gear pump 24. For example, and referring to FIG. 1, a conduit 91 can transmit exiting air from the gear pump 24 (in this case, the pressure pump 20) and to the tank 18. In another example when the gear pump 24 is the scavenge pump 16, the conduit 91 can fluidly communicate with the sump 22 and transmit exiting air from the gear pump 24 to the sump 22. Still, in other examples the exiting air could be transmitted elsewhere.

The first and second outlet openings 78, 80 are positioned in the housing 26 to accept receipt of the removed air. In the embodiment presented, and referring particularly to FIGS. 3 and 6, the first and second outlet openings 78, 80 are located generally between the first and second gears 28, 30 at the zone of meshing 46 among the sets of first teeth 52 and second teeth 66. Here, the first and second outlet openings 78, 80 are located at the timing rib 42. Furthermore, in this embodiment, the first and second outlet openings 78, 80 are aligned with the tip circumferences 60, 74 and root circumferences 62, 76, as shown in FIG. 3. That is, the first outlet opening 78 lies along the first root circumference 62 of the first roots 58 and lies along the second tip circumference 74 of the second tips 70; and the second outlet opening 80 lies along the second root circumference 76 of the second roots 72 and lies along the first tip circumference 60 of the first tips 56. Lying along these circumferences, in the embodiment presented, readies the first and second outlet openings 78, 80 to receive removed air. By the position and location of the first and second outlet openings 78, 80, air removal is incorporated into the gear pump's normal operating mode and can occur concurrently as the oil 12 exits the outlet passage 48, and without the addition of an operating mode dedicated to air removal—rather, air removal is carried out by an added stage to the normal operating mode. As described, the first and second outlet openings 78, 80 need not satisfy all of these positional and locational conditions in all embodiments.

Furthermore, in order to receive the removed air, the first and second outlet openings 78, 80 fluidly communicate with clearances established between the meshing sets of first teeth 52 and second teeth 66. Referring now to FIGS. 2, 4, and 5, the first outlet opening 78 communicates directly with a first clearance 92 upon establishment thereof, and the second outlet opening 80 communicates directly with a second clearance 94 upon establishment thereof. The first and second clearances 92, 94 are established between confronting and opposing surfaces of the tips 56, 70 and roots 58, 72 as the sets of first teeth 52 and second teeth 66 come together and come apart during meshing. As an example, and as perhaps illustrated best by FIG. 5, the second clearance 94 is defined in part by root surfaces 96 of the second roots 72 and by tip surfaces 98 of the first tips 56. The first and second clearances 92, 94 are momentarily established at separate times among the surfaces of the first and second tips 56, 70 and roots 58, 72. For instance, FIG. 2 shows the establishment of the first clearance 92 between a single first root 58 and a single second tip 70. FIG. 3 shows the first and second gears 28, 30 rotated ten degrees (10°) from their rotational positions in FIG. 2, and shows the partial establishment of the first clearance 92. In a similar manner, FIG. 4 shows the first and second gears 28, 30 rotated 10° from their rotational positions in FIG. 3, and shows the establishment of the second clearance 94 between a single second root 72 and a single first tip 56.

It is at the first and second clearances 92, 94 that air is captured amid rotation of the first and second gears 28, 30 and is urged through the first and second outlet openings 78, 80 as the air is squeezed by the meshing sets of first and second teeth 52, 66. The removal of air need not necessarily rid the oil 12 of all the air introduced in the oil 12. Without wishing to be confined to a particular theory of working, it is currently believed that the removal of air from the oil 12 is caused by the variation of g-forces experienced at the respective tips and roots of the sets of first teeth 52 and second teeth 66 during gear rotation and at teeth meshing, and the difference in densities between the air and the oil 12. In one example testing arrangement, a ratio taken between g-forces at gear roots and gear tips (g-root/g-tip) was approximately sixty-two percent (62%). The g-forces experienced at the gear tips were measurably greater than the g-forces experienced at the gear roots. That g-force differential, it is believed, coupled with the density difference between the air and oil, is what results in separation of the air from the oil 12. It is currently thought that air is pulled away from the oil 12 and is drawn toward the gear roots, or that the oil 12 is pulled away from the gear roots and air remains thereat. The example testing arrangement involved rotating a gear at 4,000 revolutions per minute (RPM); 5,000 RPM; 6,000 RPM; 7,000 RPM; 8,000 RPM; and 9,000 RPM. The g-force ratio at these distinct RPMs was consistently about 62%. The gear subject to testing had a root diameter of 32 millimeters (mm) and a tip diameter of 52 mm. Other testing arrangements may yield other results.

Removing air from the oil 12 via the gear pump 24 resolves some or all of the drawbacks set out above. The pumped oil more effectively lubricates and cools parts of the engine 14, such as the engine bearings, and facilitates the adherence of oil film on engine surfaces. Furthermore, since the air removal is effected via outlet openings incorporated in the housing 26 and does not call for added components, the packaging demands of the gear pump 14 itself are not influenced. Moreover, air-oil separators may no longer be needed in an engine oil system—for instance, the dry sump engine oil system 10 is shown lacking an air-oil separator in FIG. 1. And without an air-oil separator, the attendant packaging demands and power consumption that would otherwise arise are hence also absent. Lastly, removing the air within the gear pump 24 has the derivative effect of relieving higher pressures that can build within the gear pump 24 and that can suppress pumping action at certain times.

Referring now to FIG. 5, the gear pump 24 in this embodiment can include the valve 32 and the clutch mechanism 34. When used, the valve 32 regulates the opening and closing of the first and second outlet openings 78, 80 to permit and prevent the exit of air out of the gear pump 24. A control module 100, such as an engine control module, can be used to manage and command the action of the valve 32 in application. In an example, the valve 32 is closed at times during operation of the gear pump 24 in order to build pressure within the gear pump 24 and minimize potential pump losses. In yet a further example, a duty cycle of the valve 32 can be effected in view of one or more of the following factors: pressure of the oil 12 in the engine 14, aeration of the oil 12, and/or temperature of the oil 12. That is, as the temperature of the oil 12 increases, the duty cycle of the valve 32 may be limited, and hence exiting air limited, in order to maintain a suitable overall pressure of the oil 12 in the engine 14. Similarly, as a percentage of aeration of the oil 12 rises, the duty cycle of the valve 32 may be limited, and hence exiting air limited, in order to maintain a suitable overall pressure of the oil 12 in the engine 14. The valve 32 can be disposed at or near the first and second outlet openings 78, 80 and downstream of the outlet 85, and can be installed in conduits leading from the first and second outlet openings 78, 80. In FIG. 1, for instance, the valve 32 is shown installed in the conduit 91. The valve 32 could be a check valve or another type of valve.

When used, the clutch mechanism 34 governs rotational speed of the first and second gears 28, 30. A control module 102, such as an engine control module, can be used to manage and command the action of the clutch mechanism 34 in application. The clutch mechanism 34 is actuated and deactuated to increase and decrease the driven rotation of the first and second gears 28, 30, and thereby increase and decrease the movement of the oil 12 through the gear pump 24 as demanded in the larger engine oil system. The clutch mechanism 34 can be operably associated with the driving second gear 30 via connection to the second gear shaft 64, and itself can be driven off of an engine crankshaft or camshaft of the larger internal combustion engine assembly. The clutch mechanism 34 could be an electric clutch mechanism or another type of clutch mechanism.

Figure 8:
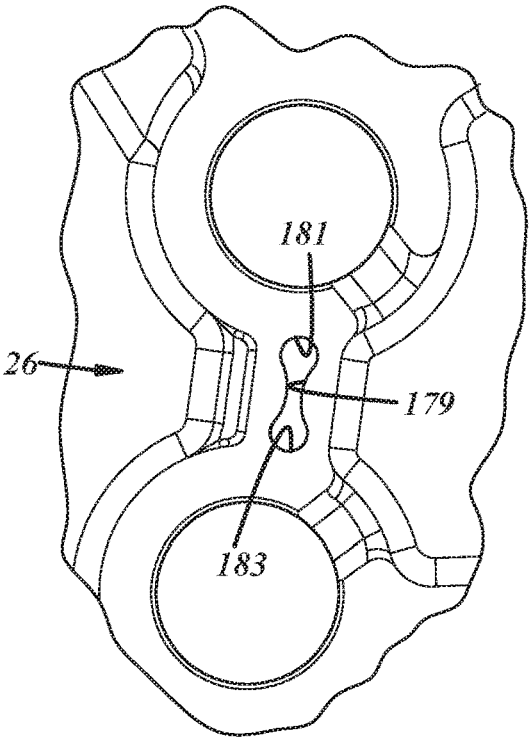
FIG. 8 is an enlarged view of another embodiment of an outlet opening of the gear pump.
Figure 9:
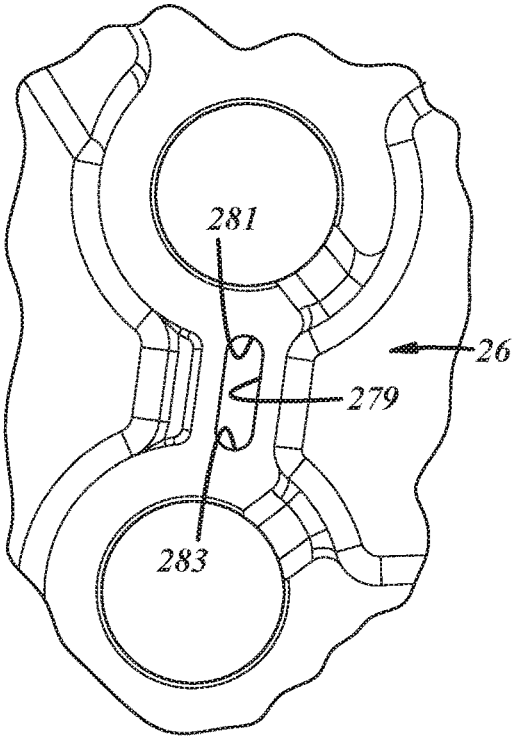
FIG. 9 is an enlarged view of yet another embodiment of an outlet opening of the gear pump.

FIGS. 8 and 9 depict a second and third embodiment of the gear pump 24. In these embodiments, only the outlet opening is presented in alternative forms; the other components of the gear pump 24 remain unaltered and hence their descriptions set forth with the embodiment of FIGS. 2-7 apply equally here. Referring to the embodiments of FIGS. 8 and 9, air exits the housing 26 by way of a single outlet opening rather than a pair of outlet openings of the previous embodiment. The single outlet opening performs the functions provided by the pair of outlet openings of the previous embodiment. In the second embodiment of FIG. 8, a single outlet opening 179 is defined and located in the housing 26. Here, the outlet opening 179 is peanut-shaped and has an extent that spans between both of the first and second clearances 92, 94 in order to receive the removed air urged out of both the first and second clearances 92, 94. The outlet opening 179 has a first section 181 that communicates directly with the first clearance 92 upon establishment thereof, and has a second section 183 displaced from the first section 181 that communicates directly with the second clearance 94 upon establishment thereof. Similarly, in the third embodiment of FIG. 9, a single outlet opening 279 is defined and located in the housing 26. Here, the outlet opening 279 is slot-shaped and has an extent that spans between both of the first and second clearances 92, 94 in order to receive the removed air urged out of both the first and second clearances 92, 94. The outlet opening 279 has a first section 281 that communicates directly with the first clearance 92 upon establishment thereof, and has a second section 283 displaced from the first section 281 that communicates directly with the second clearance 94 upon establishment thereof.

Furthermore, in yet another embodiment—this one not depicted—a single outlet opening could be provided in the housing that only communicates directly with the first clearance or with the second clearance, and need not communicate with both of the first and second clearances.

It is to be understood that the foregoing is a description of one or more aspects of the disclosure. The disclosure is not limited to the particular embodiment(s) disclosed herein, but rather is defined solely by the claims below. Furthermore, the statements contained in the foregoing description relate to particular embodiments and are not to be construed as limitations on the scope of the disclosure or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A gear pump, comprising:

a housing having an outlet passage for oil to exit the gear pump, the housing having at least one outlet opening for air to exit the gear pump, the at least one outlet opening extending through the housing from at least one inlet to at least one outlet;

a first gear disposed within the housing, the first gear having a set of first teeth with a plurality of first roots and a plurality of first tips;

a second gear disposed within the housing, the second gear having a set of second teeth with a plurality of second roots and a plurality of second tips, the set of second teeth mesh with the set of first teeth upon use of the gear pump; and at least one gear shaft about which the first gear rotates or the second gear rotates;

wherein the at least one outlet opening is situated at a location in the housing to communicate with a first clearance established between a confronting first root and second tip, or with a second clearance established between a confronting second root and first tip, or with both the first clearance and the second clearance upon respective establishment of the first and second clearances.

2. The gear pump of claim 1, wherein the at least one outlet opening is situated at a timing rib of the housing, the timing rib being interposed between a vacuum side of the gear pump and a pressure side of the gear pump.

3. The gear pump of claim 1, wherein the at least one outlet opening is situated adjacent a first tip circumference of the plurality of first tips, or adjacent a second tip circumference of the plurality of second tips, or adjacent both the first tip circumference and the second tip circumference.

4. The gear pump of claim 1, wherein the at least one outlet opening is situated adjacent a first root circumference of the plurality of first roots, or adjacent a second root circumference of the plurality of second roots, or adjacent both the first root circumference and the second root circumference.

5. The gear pump of claim 1, wherein the first gear and the second gear and the at least one outlet opening are configured in order to urge air captured within the first clearance, or within the second clearance, or within both the first and second clearances, to exit the gear pump via the at least one outlet opening upon meshing of the set of first teeth and the set of second teeth.

6. The gear pump of claim 1, wherein the at least one outlet opening includes a first outlet opening and a second outlet opening, the first outlet opening being situated at a first location in the housing that communicates with the first clearance upon establishment of the first clearance, and the second outlet opening being situated at a second location in the housing that communicates with the second clearance upon establishment of the second clearance.

7. The gear pump of claim 1, wherein the at least one outlet opening is a single outlet opening that is situated in the housing to communicate with both the first clearance upon establishment thereof and the second clearance upon establishment thereof.

8. The gear pump of claim 1, further comprising a valve disposed at or adjacent the at least one outlet opening and configured to regulate the exit of air via the at least one outlet opening.

9. The gear pump of claim 8, wherein the valve regulates the exit of air via the at least one outlet opening based on pressure of oil, based on aeration of oil, or based on temperature of oil, or based on a combination thereof.

10. The gear pump of claim 1, further comprising a clutch mechanism operably associated with the first gear, or with the second gear, or with both the first gear and the second gear, and configured to govern rotational speed thereof.

11. A dry sump engine oil system comprising the gear pump of claim 1, wherein the gear pump serves as a scavenge pump or a pressure pump in the dry sump engine oil system and the dry sump engine oil system lacks an air-oil separator.

12. A gear pump, comprising:

a housing having at least one outlet opening for air to exit the gear pump, the at least one outlet opening having at least one inlet and at least one outlet;

a first gear disposed within the housing, the first gear having a set of first teeth with a plurality of first roots, the plurality of first roots defining a first root circumference;

a second gear disposed within the housing, the second gear having a set of second teeth with a plurality of second roots, the plurality of second roots defining a second root circumference, the set of second teeth mesh with the set of first teeth upon use of the gear pump; and at least one gear shaft about which the first gear rotates or the second gear rotates;

wherein the at least one outlet opening is situated adjacent the first root circumference, or adjacent the second root circumference, or adjacent both the first root circumference and the second root circumference, wherein the set of first teeth have a plurality of first tips and the set of second teeth have a plurality of second tips, the at least one outlet opening is situated in the housing to communicate with a first clearance established between a confronting first root and second tip, or with a second clearance established between a confronting second root and first tip, or with both the first clearance and the second clearance upon respective establishment of the first and second clearances.

13. The gear pump of claim 12, wherein the at least one outlet opening is situated in the housing at a zone of meshing of the set of first teeth and the set of second teeth.

14. The gear pump of claim 12, wherein the at least one outlet opening includes a first outlet opening and a second outlet opening, the first outlet opening being situated along the first root circumference, and the second outlet opening being situated along the second root circumference.

15. The gear pump of claim 12, wherein the at least one outlet opening is a single outlet opening with a section situated along the first root circumference and another section situated along the second root circumference.

16. The gear pump of claim 12, wherein the first gear and the second gear and the at least one outlet opening are configured in order to urge air captured within the first clearance, or within the second clearance, or within both the first and second clearances, to exit the gear pump via the at least one outlet opening upon meshing of the plurality of first teeth and the plurality of second teeth.

17. An engine oil system comprising the gear pump of claim 12.

18. A gear pump, comprising:

a housing having an outlet passage for oil to exit the gear pump, the housing having at least one outlet opening for air to exit the gear pump, the at least one outlet opening having at least one inlet and at least one outlet;

a first gear disposed within the housing, the first gear having a set of first teeth with a plurality of first roots and a plurality of first tips, the plurality of first roots defining a first root circumference, the first gear rotating about a first gear shaft; and a second gear disposed within the housing, the second gear having a set of second teeth with a plurality of second roots and a plurality of second tips, the plurality of second roots defining a second root circumference, the set of second teeth mesh with the set of first teeth upon use of the gear pump, the second gear rotating about a second gear shaft;

wherein the at least one outlet opening is situated adjacent the first root circumference, or adjacent the second root circumference, or adjacent both the first root circumference and the second root circumference; and wherein the at least one outlet opening is situated in the housing to communicate with a first clearance established between a confronting first root and second tip, or with a second clearance established between a confronting second root and first tip, or with both the first clearance and the second clearance upon respective establishment of the first and second clearances.

19. The gear pump of claim 18, wherein the at least one outlet opening is situated adjacent a first tip circumference of the plurality of first tips, or adjacent a second tip circumference of the plurality of second tips, or adjacent both the first tip circumference and the second tip circumference.

* * * * *